US005351362A

United States Patent [19]

Krämer et al.

[11] Patent Number: 5,351,362

[45] Date of Patent: Oct. 4, 1994

[54] ACTIVE VACUUM CLEANER NOZZLE

[75] Inventors: Wilfried Krämer, Reichshof-Odenspiel; Klaus-Dieter Riehl, Drolshagen, both of Fed. Rep. of Germany

[73] Assignee: Wessel-Werk G.m.b.H. & Co. Kommanditgesellschaft, Reichshof-Wildbergerhutte, Fed. Rep. of Germany

[21] Appl. No.: 918,413

[22] Filed: Jul. 22, 1992

[30] Foreign Application Priority Data

Aug. 7, 1991 [DE] Fed. Rep. of Germany ..... 9109809

[51] Int. Cl.[5] ..... A47L 5/26

[52] U.S. Cl. ..... 15/387; 15/396; 15/400; 15/410

[58] Field of Search ..... 15/321, 381, 342, 354, 15/355, 363, 364, 366, 375, 391, 396, 400, 410, 412, 377, 389, 392

[56] References Cited

U.S. PATENT DOCUMENTS

| | | | |
|---|---|---|---|
| 2,016,158 | 10/1935 | Vartanian | 15/396 |
| 2,672,643 | 3/1954 | Langille | 15/392 |
| 2,706,826 | 4/1955 | Brock | 15/375 |
| 2,974,347 | 3/1961 | Seyfried | 15/364 |
| 2,997,729 | 8/1961 | Kasper | 15/355 |
| 3,005,224 | 10/1961 | Magarian | 15/391 |
| 3,482,276 | 12/1969 | Fillery | 15/392 |
| 3,614,705 | 10/1971 | Descarries et al. | 15/410 |
| 3,688,339 | 9/1972 | Vincent et al. | 15/392 |
| 3,872,539 | 3/1975 | Doyel | 15/392 |
| 3,936,905 | 2/1976 | Stewart et al. | 15/354 |
| 4,306,330 | 12/1981 | Jinkins | 15/392 |
| 4,397,060 | 8/1983 | Jinkins et al. | 15/387 |
| 4,841,594 | 6/1989 | Elson et al. | 15/391 |
| 4,980,945 | 1/1991 | Bewley | 15/377 |
| 5,031,266 | 7/1991 | Tillman et al. | 15/410 |
| 5,088,149 | 2/1992 | Berg et al. | 15/387 |
| 5,101,534 | 4/1992 | Watanabe et al. | 15/377 |

FOREIGN PATENT DOCUMENTS

| | | | |
|---|---|---|---|
| 0061826 | 10/1982 | European Pat. Off. . | |
| 1040849 | 6/1952 | Fed. Rep. of Germany . | |
| 1243346 | 6/1967 | Fed. Rep. of Germany . | |
| 3643498 | 6/1988 | Fed. Rep. of Germany . | |
| 3722961 | 1/1989 | Fed. Rep. of Germany . | |
| 0855744 | 12/1960 | United Kingdom | 15/375 |
| 0958803 | 5/1964 | United Kingdom | 15/387 |

*Primary Examiner*—David A. Scherbel
*Assistant Examiner*—James F. Hook
*Attorney, Agent, or Firm*—Meltzer, Lippe, Goldstein, Wolf Schlissle & Sazer

[57] ABSTRACT

The active vacuum cleaner nozzle of the invention exhibits a two-part housing having an attached suction pipe connecting socket. The two housing parts are pivotably hinge-connected to each other at their end opposite to the suction pipe connecting socket, the dividing joint between the two housing parts extending at least into the area of the suction pipe connecting socket. On the suction pipe connecting socket, a locking sleeve is disposed such that it can be displaced between a position enabling the housing to be opened and a locking position and such that it can be locked in place.

9 Claims, 3 Drawing Sheets

ACTIVE VACUUM CLEANER NOZZLE

The invention relates to an active vacuum cleaner nozzle of the type specified in the preamble of patent claim 1.

Compared with so-called static vacuum cleaner nozzles, i.e. nozzles which clean purely by suction without any auxiliary elements, so-called active vacuum cleaner nozzles, i.e. nozzles which produce within the nozzle itself, in addition to the suction effect, an active-cleaning effect, are in the ascendancy. For this purpose, electromotively or pneumatically driven brush rollers are widely in use.

With this in mind, the present invention relates specifically to a vacuum cleaner nozzle having an additional power-driven brush roller.

In the case of active vacuum cleaner nozzles of this type, the inconvenience involved in maintaining the nozzle has to be tolerated in return for the benefit of an improved cleaning effect. As a result of the improved take-up capacity of the nozzle, the nozzle is able to pick up not only very fine dust particles, but also more coarse particles, threads and matted fibers, which can result, particularly in the brush area and, particularly in the case of turbo drive systems, also in the turbine area, in the free rotatability of the roller or of the turbine wheels being impaired.

German patent application DE 41 21 130.8, which is not a prior publication, discloses an active vacuum cleaner nozzle of the generic type, which essentially comprises a two-part housing having a housing top part and a housing bottom part, the housing top part being able to be pivoted about the rotational axis of the brush roller out of a closed position into an open position for the purpose of maintaining the interior of the housing. The housing can here be locked in the closed position by a housing part, provided with the suction pipe connecting socket, of the drive housing, which housing part is pivotable about the turbine rotational axis running parallel to the brush axis. The locking mechanism and hence the nozzle housing can be opened in this case by pivoting the suction pipe and hence, via the suction pipe connecting socket, the turbine housing part, into a maintenance position, whilst locking can be achieved by moving the suction pipe into the working or operating position.

Although this vacuum cleaner nozzle is totally satisfactory in terms of the easy maintenance of the housing interior, accidental unlocking and hence opening of the nozzle housing cannot reliably be avoided under all conditions, in particular when carrying the entire vacuum cleaner with suction pipe and nozzle, the nozzle being raised from the ground.

Based on this prior art, the object of the present invention is to provide an active vacuum cleaner nozzle of the type specified in the introduction, which, in addition to convenient, user-friendly maintenance and accessibility to the entire nozzle interior, at the same time offers an absolutely secure locking of the housing and hence a reliable protection against accidental opening.

This object is achieved by an active vacuum cleaner nozzle according to the teaching of patent claim 1.

Advantageous designs of the invention form the subject-matter of the subclaims.

The active vacuum cleaner nozzle according to the present invention exhibits a two-part housing, in which there are disposed at least one brush roller, a drive system and a gear system transmitting the torque of the drive system to the brush roller. The drive can here be realised both electromotively and pneumatically, for example by a turbine wheel, known per se, which is driven by the suction air of the vacuum cleaner. At the same time, the gear system for the purposes of the present invention means in the general case, but by no means exclusively, a synchronous belt drive. The housing top part is mounted pivotably, in relation to the housing bottom part, between a first position allowing access to the housing interior and a lockable second position which closes the housing, the pivot axis at least running parallel to the rotational axis of the brush roller, yet preferably coinciding with it. The latter embodiment, in particular, enables optimal access to the housing interior with all its functional elements.

According to the present invention, the dividing joint between the two housing parts extends at least into the area of the suction pipe connecting socket. "At least" signifies here that, in the extreme case, the suction pipe connecting socket can also be fully axially divided by the dividing joint. In other words, when the nozzle housing is opened up, one part of the suction pipe connecting socket remains on the housing top part and the second part of the suction pipe connecting socket remains on the housing bottom part. On the suction pipe connecting socket there is displaceably disposed in axial manner, i.e. in the longitudinal direction of the suction pipe connecting socket, a locking sleeve, the displaceability having to be guaranteed, at least between a first position enabling the housing to be opened and a locking position. The locking position is here distinguished by the fact that the locking sleeve in this position surrounds both areas of the suction pipe connecting socket, i.e. both the area on the housing top part and the area on the housing bottom part, and hence prevents the housing from opening up.

In order to protect against unintentional axial displacement of the locking sleeve from the locking position into the open position and hence to protect against accidental opening of the housing, at least one of the two housing parts exhibits in the area of the suction pipe connecting socket a first locking element, which in the closed position can be detachably engaged with a complementary second locking element of the locking sleeve. Locking elements of this type can here be disposed on the top part or bottom part of the housing or even on both housing parts.

According to a preferred illustrative embodiment, the suction pipe connecting socket is overall of essentially cylindrical configuration. As explained above, the dividing joint can here run over the entire axial length of the suction pipe connecting socket. Preferably, however, the dividing joint runs such that only the axially inner area, i.e. the area pointing away from the suction pipe-side end of the suction pipe connecting socket, is divided by the dividing joint, in such a way that an essentially cylindrical-semimonocoque area of the suction pipe connecting socket is produced, which is attached to the first of the two housing parts, for example to the housing top part, whilst the other part of the suction pipe connecting socket is part of the second housing part, i.e. in this case, for example, the housing bottom part. In the case of this illustrative embodiment, the suction pipe connecting socket area on the housing bottom part comprises a cylindrical, circularly closed area located on the suction pipe side, which area is attached by a cylindrical-semimonocoque area, open in the direction of the housing top part, to the housing bottom part. Whenever the housing is closed, the two cylindrical-semimonocoque areas on the housing top part and housing bottom part are re-integrated to form in total a cylindrically closed area of the suction pipe connecting socket.

In the case of the above illustrative embodiment, the first locking element is preferably configured as a resilient catch tongue on the cylindrical-semimonocoque area of the first housing part, which tongue, or the blocking area of which, can be detachably engaged into a recess of the locking sleeve. The recess of the locking sleeve thereby represents the second locking element, complementary to the first locking element.

The catch tongue can be most simply formed by two slot-like indentations in the suction pipe-side end of the cylindrical-semimonocoque area; the actual blocking element is formed by a catch button which is disposed, projecting radially outward, on the free end of the catch tongue.

The recess of the locking sleeve receiving the catch button of the catch spring tongue can be designed in any desired manner, provided that the blocking effect is reliably secured. Preferably, however, this recess is configured as an arc-shaped, long-hole-type sleeve slot extending in the peripheral direction, thereby, on the one hand, reliably securing the blocking effect in the axial direction and hence protecting the blocking effect against the locking sleeve being pulled down and, on the other hand, enabling limited twisting of the locking sleeve on the suction pipe connecting socket. The locking sleeve can be twisted in this case by an angle which is limited as a function of the length of the sleeve slot. Such twistability of the locking sleeve in relation to the suction pipe connecting socket and hence in relation to the vacuum cleaner nozzle is particularly advantageous if the locking sleeve, in addition to its closing effect, simultaneously serves to connect the nozzle to the suction pipe of a vacuum cleaner, since the locking sleeve then acts as a swivel joint, known per se, which improves the ease of handling of the vacuum cleaner.

According to a further illustrative embodiment of the invention, the second housing part, i.e. the housing part which is without a locking element, exhibits a stop element which is disposed essentially on the suction pipe-side end of the suction pipe connecting socket and which engages into a second long-hole-type sleeve slot of the locking sleeve, running essentially in the direction of the suction pipe connecting socket. The stop element and the second long-hole-type sleeve slot are here situated preferably, but by no means exclusively, essentially diametrically opposite the locking element, for example the catch spring. This pairing of stop element—second sleeve slot enables the locking sleeve to be guided axially on the suction pipe connecting socket, the length of this sleeve slot limiting the axial displaceability of the locking sleeve following its release by the resilient catch tongue. In other words, the stop element acts together with the second sleeve slot to prevent the locking sleeve from unintentionally sliding down from the suction pipe connecting socket.

In order to enable the locking sleeve, despite the axial guidance and securement, to be twistable on the suction pipe connecting socket in the closed position and hence in the working position, the locking sleeve preferably exhibits in the locking sleeve a third long-hole-type, arc-shaped sleeve slot, running in the peripheral direction, which sleeve slot is connected in a T-shape to the second sleeve slot, its length corresponding at least to the length of the first sleeve slot which interacts with the resilient catch tongue. In this case, the position of the T-shape-disposed slot pair in the locking sleeve or the position of the stop element should be selected such that the point of intersection of the two T-shape-disposed sleeve slots in the closed position, i.e. when the catch spring is engaged, lies at the axial level of the stop element.

As described above, the stop element on the second housing part acts as a protection against accidental falling down or pulling down of the locking sleeve from the suction pipe connecting socket. In order however to enable the locking sleeve, either for cleaning or repair purposes, to be removed from the suction pipe connecting socket, the locking sleeve exhibits in its inner wall a groove which is closed in the radially outward direction and which runs axially essentially parallel to the second sleeve slot. This groove runs, in this case, from the third sleeve slot to the nozzle-side end of the sleeve and opens out into there. In other words, this groove represents a continuous connection between the third sleeve slot and the surroundings. In the case of this illustrative embodiment, the stop element exhibits a radial height which is at least slightly less than the radial depth of the groove. At the same time, the width of the groove should be selected, of course, such that the stop element is able to slide in the groove with at least a small lateral play.

The locking sleeve is in this case removed from the suction pipe connecting socket in the following manner: the locking catch button is first actuated, thereby releasing the recess of the locking sleeve. This enables the locking sleeve to be displaced in the axial direction, the locking sleeve sliding by the second axially running sleeve slot along the stop element. The axial displacement is effected in this case up to the stop of the stop element at the end of the second sleeve slot, the suction pipe area of the housing part exhibiting the locking element being in this position released and the housing being enabled to be opened up. Once this is opened up, the locking sleeve is again displaced axially in the direction of the nozzle member until the stop element engages with the third sleeve slot running in the peripheral direction. In this position, the locking sleeve is rotated on the suction pipe connecting socket until reaching a position in which the stop element is able to slide into the groove in the sleeve inner wall, thereby enabling the sleeve to be pulled off from the suction pipe connecting socket.

The locking sleeve itself can be most simply configured as a single-walled sleeve which outwardly surrounds the suction pipe connecting socket. In the case of this illustrative embodiment, the inner diameter of the suction pipe connecting socket must correspond to the outer diameter of the suction pipe onto which the vacuum cleaner nozzle is to be mounted. According to a preferred illustrative embodiment of the invention, however, the locking sleeve is configured as a twin-walled sleeve, the clear inner diameter of which essentially corresponds to the outer diameter of the suction pipe to be connected, the wall of the suction pipe connecting socket being surrounded internally by the inner wall and externally by the outer wall of the locking sleeve, with a small radial play, and the sleeve slots and/or the groove being provided in the sleeve outer wall. In connection with the removability of the locking sleeve from the suction pipe connecting socket, this also allows in particular, in addition to the advantage of the secure locking of the nozzle housing, a slight adaptability of the vacuum cleaner nozzle to different suction pipe diameters, this by virtue of the fact that, without any alteration to the nozzle, the removable locking sleeve needs merely to be exchanged or replaced by a sleeve of corresponding inner diameter.

The invention is explained in greater detail below with reference to an illustrative embodiment in connection with the drawings, in which.

Figure 1:
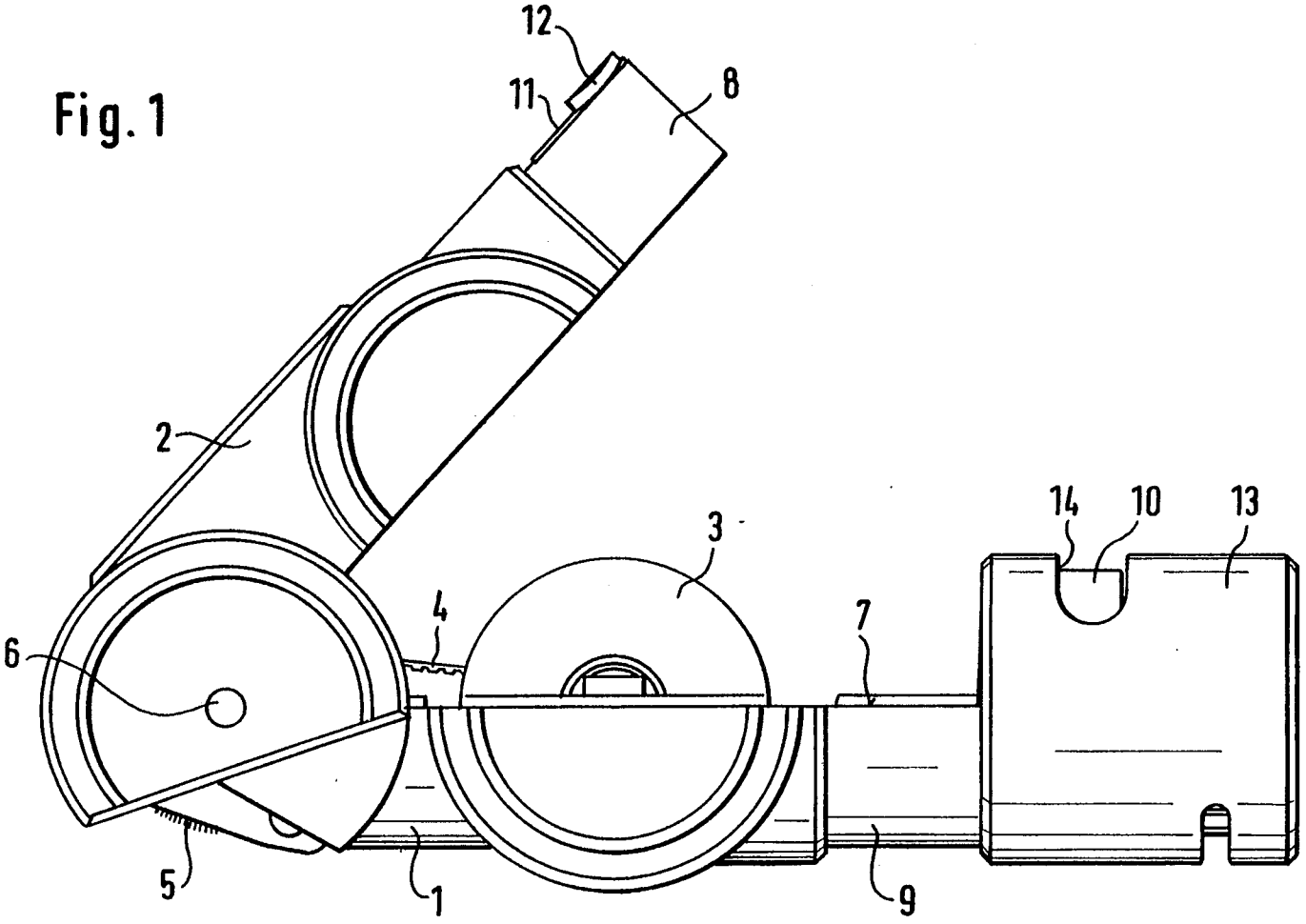
FIG. 1 shows, in diagrammatic side view, an illustrative embodiment of a vacuum cleaner nozzle in the opened up position enabling access to the interior.

FIG. 1 shows an illustrative embodiment according to the invention in the open position. The active vacuum cleaner nozzle exhibits a two-part housing, comprising a housing bottom part 1 and a housing top part 2. In the housing, there is disposed a drive system 3 in the form of a turbine wheel (represented only in diagrammatic form), a gear system 4 in the form of a toothed belt and a brush roller 5. The housing top part 2 can be pivoted in relation to the housing bottom part 1, about the rotational axis 6 of the brush roller 5, between a closed position and the here represented open position. To the housing, there is attached in total, in one piece, a suction pipe connecting socket 8, 9, 10, the suction pipe connecting socket 8, 9, 10 being divided into two areas by the dividing joint 7 between the housing top part 2 and the housing bottom part 3. The suction pipe connecting socket 8, 9, 10 exhibits, in total, a cross-sectionally cylindrical shape. A cylindrical-semimonocoque (semi-cylindrical) area 8 of the suction pipe connecting socket 8, 9, 10 is part of the housing top part 2; the other area of the suction pipe connecting socket 8, 9, 10 is part of the housing bottom part 1 and comprises an axially inner, cylindrical-semimonocoque area 9, which in the closed position is re-integrated with the cylindrical-semimonocoque area 8 of the housing top part 2 to form an in total cylindrically closed area, and an axially outer, cylindrical, circularly closed area 10.

The cylindrical-semimonocoque area 8 of the housing top part 2 exhibits a locking element in the form of a resilient catch tongue 11, which carries on its radial outer side on its free end a radially outward projecting catch button 12. The resilient catch tongue 11 is most simply formed in this case by two slot-like indentations, extending in the axial direction, in the suction pipe-side-end of the cylindrical-semimonocoque area 8. The spring effect of the catch tongue 11 is realised here by the elastic return force of the material of the housing parts 1, 2, which are preferably made of plastic.

Onto the suction pipe connecting socket 8, 9, 10, there is mounted a locking sleeve 13. This locking sleeve 13 can be displaced in the axial direction on the suction pipe connecting socket 8, 9, 10 between the open position, as shown in FIG. 1, and the locking position, as can be seen for example from FIG. 2.

The locking sleeve 13 exhibits a recess in the form of an arc-shaped, long-hole-type sleeve slot 14 extending in the peripheral direction. At the same time, the width of this sleeve slot 14 essentially corresponds to the diameter of the catch button 12. When the housing, by pivoting of the two housing parts 1 and 2, is pivoted out of the open position shown in FIG. 1 into the closed position, the locking sleeve 13 can be displaced axially in the direction of the resilient catch tongue 11; due to the spring effect, the catch button 12 is in this case forced radially inwards, so that the locking sleeve 13 is able to slide away over the catch button 12.

Figure 2:
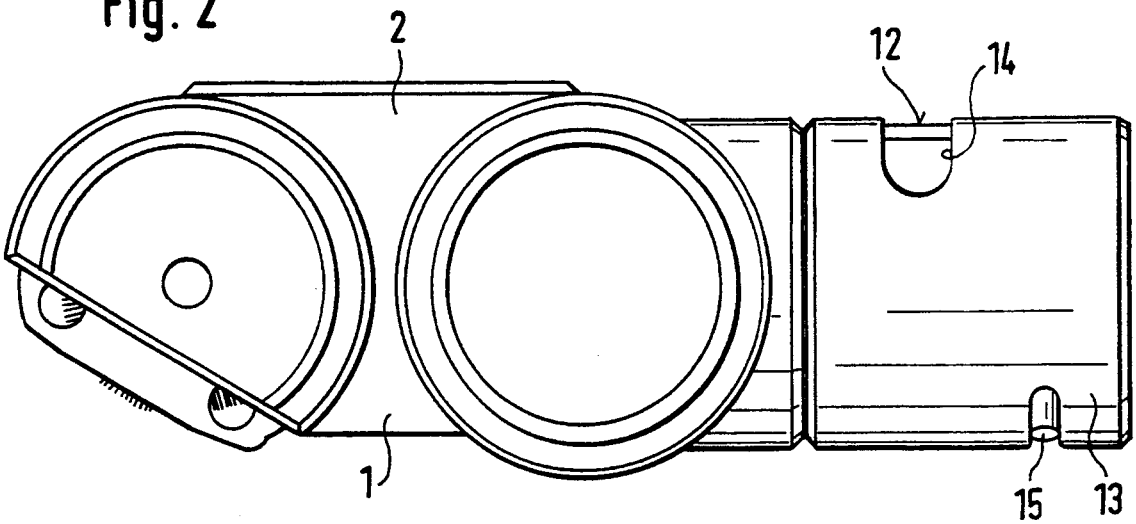
FIG. 2 shows, also in diagrammatic side view, the illustrative embodiment according to FIG. 1 in the closed and locked position.

In the locking position shown in FIG. 2, the catch button 12 and the sleeve slot 14 are brought axially into line, so that, due to the elastic return force of the resilient catch tongue 11, the catch button 12 engages radially outwards into the sleeve slot 14. The locking sleeve 13 is thereby protected against the suction pipe connecting socket 8, 9, 10 sliding axially down, a reliable locking effect being obtained, at the same time, in respect of the housing parts 1 and 2.

Figure 4:
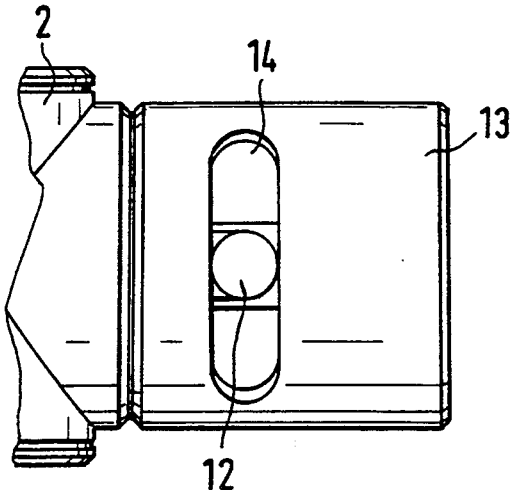
FIG. 4 shows, in top view from above, the locking sleeve according to the above illustrative embodiment.
Figure 5:
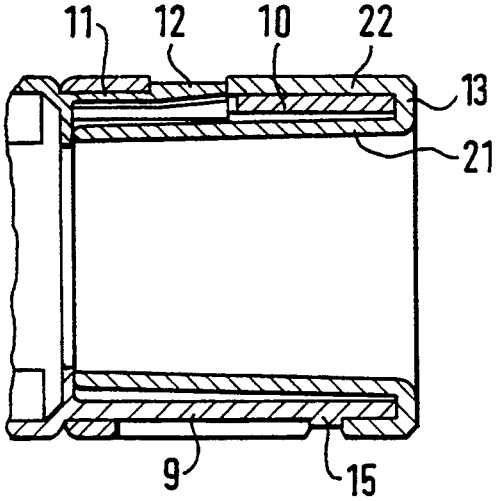
FIG. 5 shows, in axial section, the twin-walled locking sleeve according to the above illustrative embodiment.

Due to the circular arc length of the sleeve slot 14, the locking sleeve 13, in the locking position shown in FIG. 2, can be twisted by a limited angle in relation to the housing of the vacuum cleaner nozzle. This can be seen, in particular, from the representation according to FIG. 4.

Figure 3:
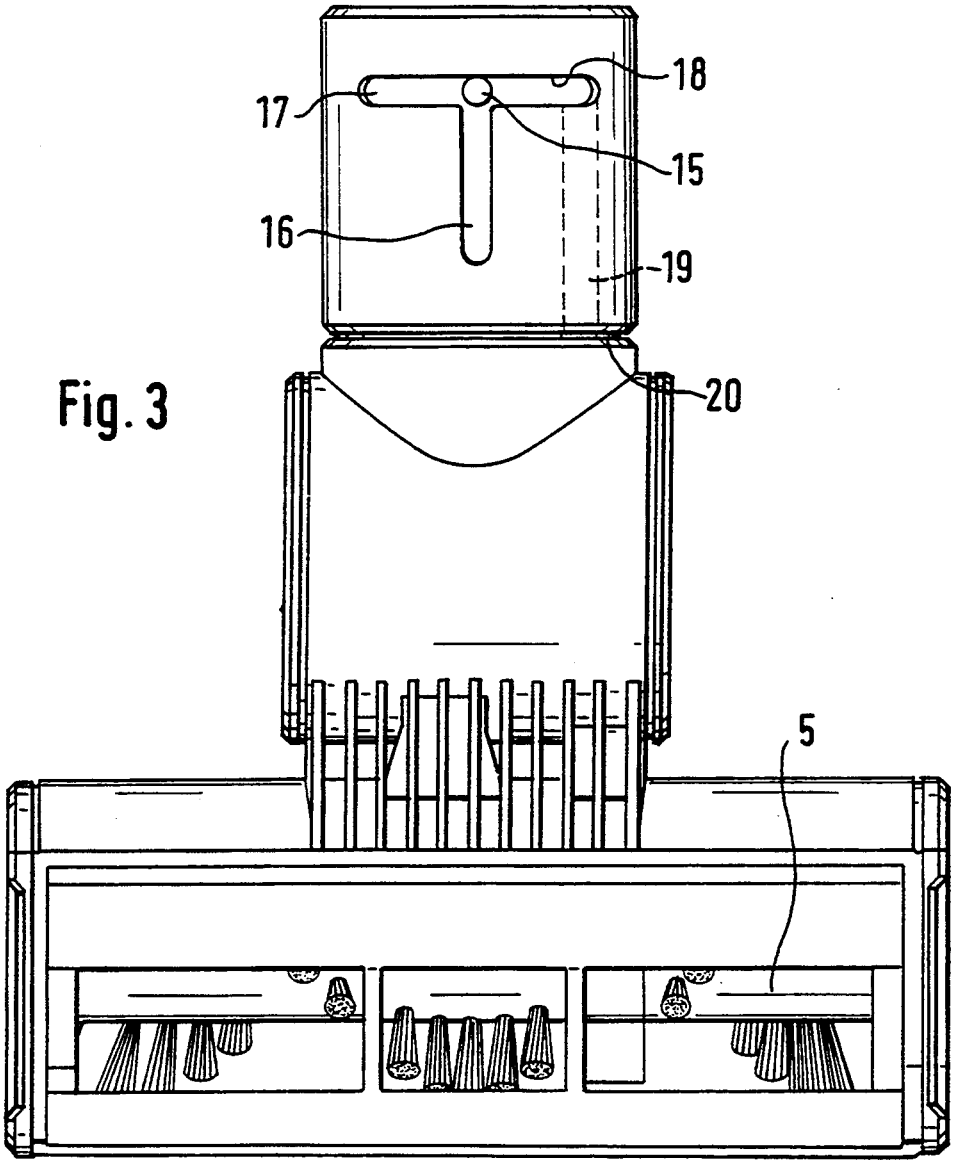
FIG. 3 shows, in a view from below, the illustrative embodiment according to FIG. 2.

As can best be seen from the representation according to FIG. 3, the housing bottom part 1 exhibits, on the suction pipe-side end of the suction pipe connecting socket 8, 9, 10, a stop element in the form of a radially projecting journal 15. The journal 15 is engaged with two T-shape-disposed sleeve slots 16 and 17 of the locking sleeve 13. In this case, the circular arc length of the sleeve slot 17 is dimensioned at least as long as the circular arc length of the first sleeve slot 14, so that the twistability of the locking sleeve 13 is not hindered. Upon the unlocking and hence axial retraction of the locking sleeve 13, the axially running sleeve slot 16, in interaction with the journal 15, represents a stop, which reliably prevents the locking sleeve from being unintentionally detached from the suction pipe connecting socket. The length of the sleeve slot 16 should here be selected, in any event, such that, in the end position, both the resilient catch tongue 11 and the cylindrical-semimonocoque area 8 of the suction pipe connecting socket of the housing top side 2 are released.

Following unlocking of the housing, the locking sleeve is located on the suction pipe connecting socket in the position shown in FIG. 1. In this position, due to the axially running sleeve slot 16, it is not possible for the locking sleeve to be twisted. After the housing top part 2 has been opened up, the locking sleeve 13 can be displaced axially inwards until reaching a position corresponding approximately to the locking position; this position is brought about by the axial butting of the journal 15 against the axially outer longitudinal wall 18 of the sleeve slot 17. In this position, the locking sleeve 13 can now be twisted by an angle corresponding to the arc length of the sleeve slot 17.

The locking sleeve 13 exhibits in its inner wall a groove 19 which is closed in the radially outward direction and which runs essentially parallel to the sleeve slot 16, as indicated by the dashed line in FIG. 3. In this representation, the groove 19 is connected by its axially outer end to the sleeve slot 17 and opens out, by its axially opposite end, at the nozzle-side end 20 of the locking sleeve 13. At the same time, the height of the journal 15 and the radial depth of the groove 19 are coordinated such that the journal 15 can be moved without hindrance in the groove 19. By twisting the locking sleeve 13 when the housing is open, the locking sleeve 13 can now be brought, in relation to the journal 15, into a position in which the locking sleeve 13 can be pulled completely off from the suction pipe connecting socket 8, 9, 10. Since the pulling-off requires the locking sleeve to be twisted deliberately, any unintentional sliding down is virtually precluded.

In the case of the illustrative embodiment represented in the drawings, the locking sleeve 13 is configured as a twin-walled sleeve having an inner wall 21 and an outer wall 22. The long-hole-type sleeve slots 14, 16, 17 and the groove 19 are in this case configured in the sleeve outer wall 22. The locking sleeve 13 is mounted onto the suction pipe connecting socket 8, 9, 10, the wall of the suction pipe connecting socket being surrounded internally by the inner wall 21 and externally by the outer wall 22 of the locking sleeve 13, with a small radial play. In this case, the clear inner diameter d of the locking sleeve 13 essentially corresponds to the outer diameter of the suction pipe (not represented) of a vacuum cleaner to which the vacuum cleaner nozzle is to be connected. Preferably, in this representation, the inner diameter d of the locking sleeve 13 can taper off conically, in a manner known per se, in an axially inward direction.

We claim:

1. An active vacuum cleaner nozzle comprising a two-part housing including a housing top part, a housing bottom part, and a suction pipe connecting socket, at least one brush roller, a drive system, and a gear system disposed within an interior of said housing, said gear system transmitting torque from said drive system to said brush roller, said housing top part being pivotable in relation to said housing bottom part about one of a rotational axis of said brush roller and an axis parallel thereto, between a first position allowing access into the interior of said housing and a lockable second position which closes said housing, a dividing joint between said housing top part and said housing bottom part which extends into said suction pipe connecting socket, a locking sleeve essentially surrounding and being axially displaceable along said suction pipe connecting socket between a position enabling said housing to be opened and a locking position which prevents opening of said housing a first locking element on said suction pipe connecting socket, and a second locking element on said locking sleeve which is detachably engaged by said first locking element to lock said housing into said closed position.

2. The vacuum cleaner nozzle of claim 1 wherein said suction pipe connecting socket is essentially cylindrical and said dividing joint divides said suction pipe connecting socket into an essentially semi-cylindrical first part which is attached to said housing top part, and a second part which is attached to said housing bottom part.

3. The vacuum cleaner nozzle of claim 2 wherein said first locking element comprises a resilient catch tongue on said semi-cylindrical first part of said suction pipe connecting socket, and said second locking element comprises a recess on said locking sleeve into which said catch tongue is detachably engaged.

4. The vacuum cleaner nozzle of claim 3 wherein said catch tongue comprises two slot-like indentations in said semi-cylindrical first part of said suction pipe connecting socket and a radially outward extending catch button on a free end of said catch tongue which is detachably engaged in said recess.

5. The vacuum cleaner nozzle of claim 4 wherein said recess comprises a first sleeve slot extending in a peripheral direction of said locking sleeve, thereby permitting limited twisting of said locking sleeve about said catch button.

6. The vacuum cleaner nozzle of claim 5, wherein said suction pipe connecting socket further comprises a stop element at a pipe-side end of said second part of said suction pipe connecting socket, and said locking sleeve comprises a second sleeve slot extending essentially in an axial direction of said locking sleeve, said second sleeve slot receiving said stop element of said suction pipe connecting socket and permitting limited axial displacement of said locking sleeve on said suction pipe connecting socket.

7. The vacuum cleaner nozzle of claim 6 wherein said locking sleeve comprises a third sleeve slot extending in a peripheral direction of said locking sleeve, said third sleeve slot being connected to said second sleeve slot in a T-shape manner, said third sleeve slot having a length which is at least equal to the length of said first sleeve slot.

8. The vacuum cleaner nozzle of claim 7 wherein said locking sleeve further comprises an axially extending groove along an inner wall of said locking sleeve, said groove being closed in a radially outward direction, said groove extending from an end of said third sleeve slot to a nozzle-side end of said locking sleeve and opening out into said nozzle-side end, said stop element having a radial height which is at least slightly less than a radial depth of said groove.

9. The vacuum cleaner nozzle of claim 8 wherein said locking sleeve comprises a twin-walled sleeve having an inner wall and an outer wall, said suction pipe connecting socket fitting into said locking sleeve so that a wall of said suction pipe connecting socket is surrounded internally by said inner wall and externally by said outer wall of said locking sleeve with a small radial play, and said first, second and third sleeve slots and said groove are located in said outer wall of said locking sleeve.

* * * * *